United States Patent [19]

Coker et al.

[11] Patent Number: 4,822,544

[45] Date of Patent: Apr. 18, 1989

[54] DRY PROCESS FOR FABRICATING A UNITARY MEMBRANE-ELECTRODE STRUCTURE

[75] Inventors: Thomas G. Coker, Lexington; Anthony R. Fragala, North Andover; Anthony B. LaConti, Lynnfield; John F. Austin, Hamilton, all of Mass.

[73] Assignee: Unitd Technologies Corporation, Hartford, Conn.

[21] Appl. No.: 90,719

[22] Filed: Aug. 28, 1987

Related U.S. Application Data

[63] Continuation of Ser. No. 874,001, Jun. 13, 1985, abandoned, which is a continuation of Ser. No. 603,481, Apr. 24, 1984, abandoned.

[51] Int. Cl.[4] ..... C04B 35/00; C25B 13/00

[52] U.S. Cl. ..... 264/104; 204/98; 204/128; 204/252; 204/282; 204/296; 264/343

[58] Field of Search ..... 264/104, 343

[56] References Cited

U.S. PATENT DOCUMENTS 4,272,353 6/1981 Lawrance et al. ..... 204/283

4,381,983 5/1983 Korach ..... 204/282

4,423,157 12/1983 Masuda ..... 204/159.17

FOREIGN PATENT DOCUMENTS 0031660 8/1981 European Pat. Off. ..... 204/282

*Primary Examiner*—John F. Niebling

*Assistant Examiner*—Kathryn Gorgos

[57] ABSTRACT

A process for fabricating a unitary membrane-electrode structure by attaching an electrode to a permselective membrane while the latter is in a non-hydrated (and essentially non-dissociated) form. The electrode, in the form of a bonded aggregate of catalytic and polymeric binder particles, is attached to a membrane having less than 0.01 grams of matrix water per gram of dry membrane by the application of heat and pressure. The membrane is then hydrated causing the membrane to swell by a controlled amount and converting it to the dissociated form. A membrane-electrode structure fabricated in this manner is particularly useful in the electrolysis of alkali metal halides because it is characterized by improved cathodic current efficiency and by reduced susceptibility to permeation of gaseous hydrogen.

9 Claims, No Drawings

DRY PROCESS FOR FABRICATING A UNITARY MEMBRANE-ELECTRODE STRUCTURE

This is a continuation of application Ser. No. 874,001 filed on June 13, 1985 abandoned Jan. 21, 1988 which is a continuation of application Ser. No. 603,481 filed on Apr. 24, 1984 abandoned June 1, 1985.

The instant invention relates to a process for fabricating a membrane-electrode structure and more particularly to a membrane-electrode structure useful in electrochemical cells.

The use of permselective membranes having at least one electrode bonded to a surface of the membrane in electrolysis cells for the production of chlorine by the electrolysis of alkali metal halides, is now well known and such cells are typically illustrated in U.S. Pat. Nos. 4,191,618, 4,212,714, and 4,333,805 assigned to the General Electric Company, the assignee of the present invention. In cells of this sort, the electrodes are attached by the application of heat and pressure to a membrane in the hydrated form, i.e. it contains the matrix water necessary for the functional groups to dissociate so that the membrane has ion transporting characteristics.

The functional groups which permit ion transport may be sulfonates, carboxylates or phosphonates, attached to a polymeric, and preferably perfluorosulfonic, backbone. The cathodic current efficiency of a cell using a unitary membrane-electrode structure, (i.e., the ability of the membrane to reject hydroxyl ions and prevent their transport to the anode) as well as the ability of the membrane to resist hydrogen permeation from the cathode to the anode, is a continuing problem in all membrane cells.

It is believed that attachment of the catalytic particles to the membrane when it is in its hydrated and swollen form permits some penetration of the catalytic particles into the swollen membrane. Because of the penetration below the membrane surface, caustic as well as some gaseous hydrogen is formed within the membrane resulting in very high concentrations of caustic and gaseous hydrogen at the surface or within the membrane. This results in back migration of the hydroxyl ions and hydrogen permeation to the anode chamber of the cell, thereby reducing the cathodic current efficiency as well as decreasing the purity of the chlorine generated in the anode chamber.

Applicants have found that the cathodic current efficiency may be increased and the hydrogen permeation rate through the membrane may be decreased by fabricating the unitary membrane electrode structure in a manner such that the electrode is attached to the membrane when the membrane is in the dry or non-swollen form and hydrating the membrane after attachment of the electrode. Furthermore, it has also been found that the adherence of the electrode to the membrane is increased several fold over its adherence when the electrode is attached to the membrane when it is in a swollen or hydrated form.

It is therefore a principal objective of the invention to provide a process for fabricating a membrane-electrode structure with improved adherence of the electrode to the membrane.

Another objective of the invention is to provide an improved membrane-electrode assembly for use in electrochemical cells in which the cathodic current efficiency and resistance of the membrane to hydrogen permeation is substantially improved.

Yet another objective of the invention is to provide a process for fabricating a membrane-electrode assembly useful in the electrolysis of alkali metal halides in which the electrode is attached to the membrane when it is in its non-hydrated and non-dissociated form.

Still another objective of the invention is to provide a process for fabicating a membrane-electrode structure with improved operating and structural characteristics.

Still other objectives of the invention will become apparent as the description thereof proceeds.

The various objectives and advantages of the invention are realized in a process for fabricating a unitary membrane-electrode structure in which the electrode is attached to the membrane when it is in its non-hydrated form so that the functional groups are not dissociated. An electrode, which is preferably in the form of a bonded aggregate of catalytic and polymeric binder particles, is attached to at least one side of the membrane by the application of heat and pressure. After application of the electrode to the membrane, the membrane is controllably hydrated with an attendant swelling or enlargement of the membrane.

The novel features which are believed to be characteristic of this invention are set forth with particularity in the appended claims. The invention itself, however, both as to its organization and mode of operation, together with further objectives and advantages, may best be understood by reference to the following description.

The instant invention relates to a process for fabricating a unitary membrane-electrode structure which is characterized by the fact that one or more electrodes may be attached to the surfaces of a permselective, and preferably cationic, membrane to form a unitary membrane electrode structure. Attachment of the electrode to the surface of the membrane is carried out while the membrane is in its non-hydrated and, therefore, non-dissociated state, with the membrane being converted to the hydrated or dissociated state after the electrode has been attached. The membrane is permselective in the sense that it has ion transporting, dissociable functional group such as sulfonates, carboxylates, phosphonates, etc. either in the acid or salt form attached to a polymeric, and preferably fluorocarbon, backbone. The functional groups, of whatever sort, will however, be in a non-dissociable or non-transporting form in the absence of matrix or pore water. That is, if the membrane is not in a hydrated state, the functional groups attached to the backbone cannot perform their ion-exchanging function.

The matrix or pore water, however, to some extent also acts as a plasticizer which swells the membrane. When the electrode is attached to a hydrated, swollen membrane, by means of heat and pressure, it is believed that some of the catalytic particles forming part of the electrode penetrate below the surface of the membrane. As a result, the electrochemical reactions forming caustic and hydrogen occur partially inside of the membrane. The caustic concentration at and below the surface of the membrane is, therefore, very high. This results in increased back migration of the hydroxyl ions and a reduction in the cathodic current efficiency of the cell. That is, the presence of some catalytic particles within the membrane affected the ability of the membrane to reject the anions. Furthermore, the presence of these same catalytic particles below the surface of the membrane resulted in the formation of gaseous hydrogen below the surface of the membrane and increased permeation of hydrogen across the membrane to the anode thereby increasing the hydrogen contents of the chlorine produced at the anode.

Applicants have found that such particulate electrodes may be attached to one or more surfaces of a permselective membrane to form a unitary membrane-electrode structure which, when utilized in a brine electrolysis cell results in much improved cathodic current efficiency and much lower hydrogen permeation provided the electrodes are attached to the membrane by heat and pressure when the membrane is in its "dry" or non-hydrated form.

What is meant by "dry" or non-hydrated membrane is a membrane which has less than 0.05 grams of water per gram of dry membrane, or stated in a different way, the matrix or pore water content is equal to or less than 5 weight percent of the dry membrane. Although the water content may be as high as 0.05 grams of water per gram of membrane, the preferred water content of the membrane during attachment of the electrode is equal or less than 0.01 grams of water per gram of dry membrane, or a water content equal to or less than 1 weight percent of dry membrane.

The attachment of the electrode to the membrane in its "dry" state is achieved by means of heat and pressure. A mixture of catalytic particles, which may be platinum group metals of platinum group metal oxides or mixtures thereof, and hydrophobic polymeric binder particles (such as polytetrafluoroethylene which may be obtained from DuPont Company under its trade name Teflon) are placed on a metallic foil substrate. Alternatively, a dual layer electrode such as nickel/platinum, which has one layer with a higher overvoltage for the reaction than the other layer may also be used. The higher over voltage layer, such as the nickel for example, is attached to the membrane. This moves the principal reaction zone, at the platinum layer, away from the membrane and aids in reducing the caustic and hydrogen concentration at the membrane surface thus also tending to reduce back migration of the hydroxyl ion and permeation of hydrogen.

One side of a "dry" membrane is placed over the powder mixture. The combination is positioned in a press and subjected to pressures ranging from 1000 to 3000 psi, with a range of 1000 to 1500 psi being preferred, at temperatures ranging from 250°–400° F. (with 325°–350° being the preferred range) for a period of time ranging from 2–30 minutes with the preferred range being from 2–10 minutes. The application of heat and pressure for the given time period bonds the polymeric and metallic particles to each other and to the membrane to form a gas and liquid permeable, porous electrode structure which is attached to the surface of the membrane. The process may be repeated with the other side of the membrane if the electrodes are to be attached to both sides of the membrane or simply to one side where only a single electrode is bonded to the membrane.

After the electrode is attached to the membrane in the dry form, the functional groups in the membrane are converted to their dissociated, permselective form by hydrating in one of a variety of ways. Thus, the hydration of the unitary membrane-electrode structure can take place by immersion in a water solution, or in aqueous solutions of 0.1 to 1.0 Normal NaOH, or $NaHCO_3$ NaCl etc., at temperatures of 25° to 100° C. for at least one (1) hour and up to 24 hours.

The duration of this hydration process should be such as to limit swelling or dimensional growth of the membrane upon hydration to 3–15% and preferably to a range between 4 and 8%. If the amount of matrix or pore water added to the membrane is thus controlled, it has been found that the electrode adheres firmly to the membrane, and as will be pointed out subsequently, the adherence is substantially greater than the adherence of the electrode when it s attached to a membrane, in a hydrated or swollen form.

The membranes, as pointed out previously, may be membranes which have sulfonate functional groups such as the type, for example, sold by DuPont under its designation Nafion 315. They may be all carboxylic membranes such as membranes sold by Asahi Glass Company under its designation Flemion. They may be hybrids or combinations of layers having different functional groups such as DuPont Nafion 90107 having both sulfonic and carboxylic groups. In the latter case, which is often preferred in brine electrolysis systems, a thin layer of a high anion rejection material such as those containing carboxylic functional groups are present on the cathode side of the membrane to assist in the overall rejection characteristic of the membrane for the hydroxyl ions. The cathode electrode would thus be attached directly to the high rejection carboxylic layer which is bonded to a main or sulfonate layer.

Prior to electrode attachment, the membrane must be treated so as to control the water content and bring it to the levels described above, i.e., preferably below 0.01 grams per gram of dry membrane or less than 1 weight percent of the dry membrane. If the membrane is received from the manufacturer in the non-hydrated form, the matrix water level may be retained in the desired range by maintaining it at 25° C. and at a relative humidity no greater than 30–40%. At greaater relative humidities, as for example at 75% relative humidity it was found that after two hours the water content rises to 3 weight percent (i.e., 0.03 grams per gram of dry membrane and so on). The critical thing, however, is to maintain water content below 5 weight percent and preferably less than 1 weight percent prior to the attachment of the electrodes. If the membrane is initially in the hydrated form, the matrix water may be removed by vacuum extraction, exposing it to high temperature at low humidities, or the like.

EXAMPLE I

In order to illustrate the effectiveness of an electrode attachment process utilizing a "dry" membrane (<0.01 g of $H_2O$/g of dry membrane), a number of membrane-electrode structures were prepared and tested to determine the relative adhesion characteristics of electrodes when attached to membranes both in the "dry" and in the "hydrated" states. Five (5) membrane-electrode structures were prepared utilizing laminate perfluorocarbon sulfonic/carboxylic acid membranes. Dual layer electrode structures containing, respectively, 2 mg/cm$^2$ Pt and 10 mg/cm$^2$ Ni layers were prepared with the Ni layer attached to the membrane.

Two (2) of the five (5) structures had the electrodes attached while the membrane was in a hydrated, or swollen state (containing 10 weight percent of water 0.10 gms $H_2O$/gm of dry membrane) by the application of 1500 psi at 350° F. for a period of eight (8) minutes. The remaining three (3) structures had electrodes attached to "dry" membranes, (i.e., membranes having a water content of less than one (1) weight percent (<0.01 gm $H_2O$/gm of dry membrane). Of these three (3), two (2) were attached by the application of 1000 psi at 325° F. for a period of eight (8) minutes, and the remaining one (1) by the application of 1500 psi at 325° for a period of eight (8) minutes. Each of the five (5) structures were tested for adhesion in an Adhesion Tester manufactured by the Instron Engineering Corp. of 100 Royal St., Canton, MA 02021. The adhesion tests were continued until the electrodes were delaminated from the membrane with the force necessary for delamination measured and recorded. Table I records the delamination data for all of the structures.

TABLE I

| Membrane-Electrode Structure | Membrane State: Wet(W) or Dry(D) | Preparation Pressure (PSI) | Temperature Condition (°F.) | Adhesion (Dynes $CM^2 \times 10^5$) |
|---|---|---|---|---|
| 1 | W | 1500 | 350 | 1.8 |
| 2 | W | 1500 | 350 | 1.2 |
| 3 | D | 1000 | 325 | 2.6 |
| 4 | D | 1000 | 325 | 3.0 |
| 5 | D | 1500 | 325 | 4.7 |

It is clear from Table I that adhesion of the electrodes is substantially improved by virtue of a "dry" attachment process. At 1500 psi and at 325°-350° F., the adhesion of the electrode attached to a "dry" membrane is 2.5 to 4.0 times better than that of an electrode attached to a hydrated membrane.

EXAMPLE II

To demonstrate the effect on cathodic current efficiency a number of brine electrolysis cells were constructed with unitary membrane-electrode structures which divided the cells into anode and cathode chambers to demonstrate the effect on cathodic current efficiency. Some of the cells used membrane-electrode structures fabricated using "dry" membranes which were subsequently hydrated and others used membrane-electrode structures fabricated with the membrane in the hydrated state.

Cathode electrodes, which were bonded agglomerates of Pt (Pt Black) and a polymeric binder (6 mg Pt+0.9 mg Teflon/$cm^2$) were attached to membranes both in the "dry" and hydrated state in the manner described in Example I. Another group of cells was prepared using dual layer Pt/Ni electrodes some of which were attached to "dry" membranes and some to hydrated membranes. In each instance, the membranes having the electrodes attached while in the dry state were hydrated prior to installation in the cells in aqueous solutions of $H_2O$, or 0.1N NaOH, or 0.1N $NaHCO_3$ at temperatures of 25° to 100° C. to achieve a 3-15% increase in membrane dimensional area.

In all instances the membranes were perfluorocarbon sulfonic/carboxylic acid membranes. The cells were operated with a saturated brine feed, at 90° C., 30A/$DM^2$ and a caustic weight concentration of 32-33%. The Life Test Summary of the cells is shown in Table II.

TABLE II

| Cell | Cathode Config. and Attachment Process | Oper. Hours | Cell Voltage | Cathodic Eff. % | Power KWH/ M.T. of NaOH |
|---|---|---|---|---|---|
| 1 | Single Layer Pt Wet Press | 4000 | 2.90 | 92 | 2110 |

TABLE II-continued

| Cell | Cathode Config. and Attachment Process | Oper. Hours | Cell Voltage | Cathodic Eff. % | Power KWH/ M.T. of NaOH |
|---|---|---|---|---|---|
| 2 | Single Layer Pt Dry Press | 3400 | 2.86 | 95 | 2020 |
| 3 | Single Layer PT - Dry Press | 2500 | 2.90 | 96 | 2025 |
| 4 | Dual Pt/Ni Wet Press | 3000 | 2.90 | 93 | 2090 |
| 5 | Dual Pt/Ni Dry Press | 2000 | 2.93 | 94 | 2090 |
| 6 | Dual Pt/Ni Dry Press | 1500 | 2.99 | 94 | 2130 |
| 7 | Dual Pt/Ni Dry Press | 400 | 2.97 | 94 | 2120 |
| 8 | Dual Pt/Ni Dry Press | 430 | 3.04 | 95 | 2140 |
| 9 | Dual Pt/Ni Dry Press | 460 | 3.00 | 95 | 2120 |
| 10 | Dual Pt/Ni Dry Press | 800 | 2.96 | 95 | 2067 |
| 11 | Dual Pt/Ni Dry Press | 480 | 3.10 | 96 | 2160 |

As may be seen from Table II, even with a high—3-2-33 weight %—caustic concentration, an improvement in cathodic current efficiency was realized in all instances where the electrode was attached to the membrane while the latter was in the "dry" state.

EXAMPLE III

Cells 1, 4 and 5 of Example II were tested further to determine the effect of the attachment process—wt v. dry—on the hydrogen permeation through the membrane into the chlorine (anode) chamber. The results are shown in Table III.

TABLE III

| | Cell 1 Pt Elec. Wet Press | Cell 4 Dual Pt/Ni Wet Press | Cell 5 Dual Pt/Ni Dry Press |
|---|---|---|---|
| Current Density (A/$DM^2$) | 30 | 30 | 30 |
| Cell Voltage | 2.90 | 2.90 | 2.93 |
| NaOH wt % | 33 | 33 | 33 |
| Cathodic Eff. % | 92 | 93 | 94 |
| % $H_2$ in Chlorine | 1.0-1.5 | 0.5-0.8 | <0.1 |

It is clearly evident that hydrogen permeation through the membrane is substantially less when the membrane electrode structure is fabricated by attaching the electrode when the membrane is in the "dry" state and subsequently hydrating the membrane. In fact, the reduction in hydrogen permeation rate is decreased by at least a five-fold factor and may be decreased by as much as an order of magnitude.

In summary, the instant invention results in an improved membrane-electrode structure which is generally useful in electrochemical cells and particularly in electrolysis cells for the electrolysis of brine to produce gaseous chlorine and caustic. The improved structure has better adherence of the electrodes to the membrane; the cathodic current efficiency is improved, and there is a substantial reduction in hydrogen permeation through the membrane, thereby substantially increasing the purity of the chlorine produced in the anode chamber of the cell.

While specific embodiments and examples of the invention have been described, the invention is by no means limited to these embodiments and examples. It is intended, by the appended claims, to cover all such improvements and modifications as fall within the true scope and spirit of this invention.

What we claim as new and desire to secure by Letter Patent of the United States is:

1. In a process for attaching an electrode to an ion transporting permselective membrane, consisting essentially of the steps of
   (a) providing a permselective membrane, with ion transporting functional groups having a water content of less than 0.01 grams of water per gram of dry membrane, whereby the functional groups are in a non-dissociated state,
   (b) depositing an electrode on at least one surface of said membrane,
   (c) attaching the electrode to the dry membrane by the application of heat and pressure,
   (d) hydrating the membrane to increase the water content and convert the functional groups to a dissociated, ion transporting state and produce 3–15% dimensional growth of said membrane with the electrode attached thereto.

2. The process according to claim 1 wherein the electrode is attached to the dry membrane by applying pressure ranging from 1000–2500 psi at temperatures from 250°–400° F.

3. The process according to claim 2 wherein the electrode deposited on the membrane surface comprises an aggregate of catalytic and polymeric binder particles.

4. The process according to claim 1 wherein the membrane is hydrated after electrode attachment in an aqueous alkali metal halide solution.

5. The process according to claim 1 wherein the membrane is hydrated after electrode attachment by immersion in water.

6. The process according to claim 2 wherein an electrode in the form of a bonded aggregate of catalytic and polymeric particles is deposited and attached to the membrane by application of heat and pressure for a period of 4–10 minutes.

7. The process according to claim 2 wherein a multi layer electrode is placed on the membrane surface and attached thereto by the application of heat and pressure.

8. The process according to claim 7 wherein the layers of multilayer electrode have different overvoltages for an electrochemical reaction and the layer with the higher overvoltage is placed directly against the membrane.

9. In a process for manufacturing a membrane electrode assembly by attaching an electrode to an ion transporting permselective membrane, consisting essentially of the steps of
   (a) providing a permselective membrane having at least one surface and a thin layer of high anion rejecting material containing ion transporting dissociable functional groups; wherein said membrane has a water content of less than 0.01 grams of water per gram of dry membrane, whereby the functional groups are in a non-dissociated state,
   (b) depositing an electrode on at least one surface of said membrane,
   (c) attaching the electrode to the dry membrane by the application of heat and pressure,
   (d) hydrating the membrane to increase the water content and convert the functional groups to a dissociated, ion transporting state and produce 3–15% dimensional growth of said membrane with the electrode attached thereto resulting in a membrane in which the catalytic particles do not penetrate into the membrane surface.

* * * * *